United States Patent [19]

Bateman et al.

[11] Patent Number: 4,655,368

[45] Date of Patent: Apr. 7, 1987

[54] AUTOTELLER EXCHANGEABLE BANKNOTE CASSETTE SYSTEM

[75] Inventors: Victor E. Bateman, Crawley, England; Agnelo F. R. Gomes, Novi, Mich.

[73] Assignee: Burroughs Corporation, Detroit, Mich.

[21] Appl. No.: 716,775

[22] Filed: Mar. 27, 1985

[30] Foreign Application Priority Data

Mar. 31, 1984 [GB] United Kingdom ..... 8408360

[51] Int. Cl.[4] ..... B67B 7/24

[52] U.S. Cl. ..... 221/4; 221/7; 221/8; 221/9; 221/154; 221/197; 271/163; 271/164; 340/825.35; 109/39; 109/44; 109/45; 109/47; 109/52; 109/64

[58] Field of Search ..... 221/4, 2, 9, 197, 198, 221/285, 154, 8, 7, 287; 271/162, 163, 164; 194/DIG. 26, 1 R; 340/825.35; 235/381, 380; 232/15, 16; 109/44, 52, 64, 38, 43, 45, 47, 49, 57, 66, 39, 24.1

[56] References Cited

U.S. PATENT DOCUMENTS

| | | | |
|---|---|---|---|
| 3,949,364 | 4/1976 | Clark et al. | 340/825.35 X |
| 4,113,140 | 9/1978 | Graef et al. | 221/227 X |
| 4,134,537 | 1/1979 | Glaser et al. | 235/381 X |
| 4,189,139 | 2/1980 | Uchida et al. | 271/162 |
| 4,214,237 | 7/1980 | Zissimopoulos | 221/4 X |
| 4,235,433 | 11/1980 | Hirata | 221/197 X |
| 4,251,010 | 2/1981 | Schmeykal et al. | 221/2 X |
| 4,370,006 | 1/1983 | Graef et al. | 232/15 X |
| 4,459,052 | 7/1984 | Lundblad | 194/DIG. 26 |

*Primary Examiner*—Joseph J. Rolla
*Assistant Examiner*—David H. Bollinger
*Attorney, Agent, or Firm*—Mark T. Starr

[57] ABSTRACT

An autoteller accepts on a ramp exchangeable banknote cassettes which can only be opened at the predetermined angle of the ramp when a key assembly on the ramp is presented to a lock. The cassettes may only have the key assembly presented to the lock when not on the ramp at an angle to the horizontal, whereat opening of the doors on the cassette is prevented by a blocking bar swinging to engage a notch in the opening mechanism to prevent operation of the opening mechanism. A processor in the autoteller accepts a password from an internal keypad, enters a wide access bank service routine if a first password is provided and a restrictive access third party service routine if a second password is provided, shutting down the autoteller if no correct password is provided within a predetermined number of tries in a predetermined time. In the third party service routine, the processor commands an internal printer to provide a first audit slip to the service personnel indicative of a running audit on the autoteller before servicing and after servicing the processor commands the printer to provide a second audit slip indicative of the running audit of the autoteller after servicing, the first and second audit slips providing accountability of the actions of service personnel.

22 Claims, 19 Drawing Figures

AUTOTELLER EXCHANGEABLE BANKNOTE CASSETTE SYSTEM

BACKGROUND TO THE INVENTION

1. Field of the Invention

The present invention relates to autotellers for dispensing money and receiving deposits for bank customers upon proof of valid access. The present invention more precisely relates to a system whereby service personnel from a third party, outside contractural service, can exhange pre-loaded banknote cassettes in the autoteller outside of normal banking hours and over weekends and holidays without the risk of pilferage.

2. The Prior Art

It is known to provide an autoteller with replaceable banknote cassettes. The cassettes are loaded into predetermined position in the autoteller dependently upon the denomination of the notes contained therein. The autoteller thereafter, when accessed by a customer, dispenses banknotes from the cassette as required by use of a conveyor mechanism.

The cassettes are pre-loaded by bank staff with a known amount of money. Exchange of a full cassette for an empty or part empty cassette can be performed by the bank staff during normal banking hours. However, where use of an autoteller is high it may be necessary to exchange banknote cassettes overnight. Similary, over weekends or during holidy periods the autoteller may require regular attendance despite absence of banking staff. It is therefore the practice for the bank to engage the services of a third party security firm to perform so-called third party service of the autoteller outside of banking hours.

The bank provides to the third party servicing agency a supply of pre-loaded banknote cassettes. When required, third party service personnel from the servicing agency perform a third party service for the autoteller. In the third party service, limited access is provided to the workings of the autoteller for the service personnel to provide minor mechanical corrections of any malfunctions and to exchange full cassettes for empty or part empty cassettes. In the third party service the servicing personnel may change ink ribbons on printers, clear any jammed notes and, in the last resort, summon a competent servicing engineer.

A problem exists with possible pilferage by third party service personnel. The third party service personnel are not subject to the same degree of vetting and security in general terms as are bank staff. While it is easy to detect the theft and breaking open of a complete cassette, it is not so easy to detect opening and re-closing of a cassette or the appropriation of occasional banknotes from the autoteller.

In order to prevent opening and re-closing of a cassette, there have in the past been attempts to provide a cassette which can only be opened in the autoteller. In one prior art solution, a cassette was provided with a lock which was primed at the time of loading with banknotes in the bank. The box was thereafter openable on ony one occasion upon presentation to a predetermined key held in the autoteller. Upon withdrawal of the cassette from the autoteller the cassette automatically re-locked itself to deny access to its interior. This system, employing a once-openable cassette, was not entirely foolproof. The key in the autoteller was accessible for inspection so that a duplicate could be made. Thereafter, a cassette could be opened, one or two banknotes only withdrawn, and re-closed. The pilferer could then claim a malfunction of the cassette, secure in the knowledge that the missing one or two banknotes may be thought the result of human error. On the other hand, an honest operative may accidentally drop or knock the cassette causing the one-shot lock mechanism to trigger, causing the cassette to remain closed. A triggered cassette cannot be loaded into the autoteller and, as a consequence, the autoteller may be forced to close down despite the availability of replacement banknotes.

Third party service personnel regularly clear jammed banknotes from the banknote dispensing apparatus. It is a problem with autotellers that occasionally two or more banknotes will be dispensed in place of a single banknote originally required. There is thus a small random loss of banknotes by the autoteller. There is some degree of unaccountability within the autoteller within small limits. Dishonest third party servicing personnel therefore are in a position to remove occasional jammed banknotes from the banknote dispensing conveyor and appropriate them secure in the knowledge that the missing banknote or banknotes will be thought to have been erroneously multiply dispensed.

SUMMARY OF THE INVENTION

It is therefore desirable to provide a system wherein exchangeable banknote cassettes are provided for an autoteller which are not openable externally to the autoteller, but which are not subject to self-locking as a result of mechanical shock. It is yet further to provide in such a system that small scale pilferage is detectable.

From a first aspect, the present invention consists in a system for providing dispensable banknotes from an exchangeable banknote cassette in an autoteller, said system comprising; a cassette for holding a supply of banknotes, said cassette comprising an opening mechanism for opening a door in said cassette to allow access to the supply of banknotes, a lock mechanism reversably operable in response to the insertion and turning therein of a predetermined key to pass from a locked state wherein said lock mechanism is operative to prevent operation of said opening mechanism to an open state wherein said lock mechanism is operative to allow operation of said opening mechanism, said lock mechanism being operable to retain said key when in said open state, and a tilt sensor operable to prevent operation of said opening mechanism if said cassette is not within a predetermined range of angles to the horizontal; said system further comprising a banknote dispenser, said dispenser comprising a ramp for holding said cassette at an angle to the horizontal which is within said predetermined range and a key assembly for holding said key as a captive key and for presenting said key to said lock mechanism, said dispenser and said cassette being cooperative to prevent external access to the supply of banknotes when said opening mechanism is operated with said cassette on said ramp and said lock mechanism being presentable to said key when said cassette is not on said ramp only with said cassette at an angle to the horizontal which is outside of said predetermined range.

From a second aspect, the present invention consists in a system according to the first aspect further characterized by comprising a processor, coupled to monitor transactions carried out by said autoteller and operable to maintain a continuous audit of said autoteller, and a printer, internal to said autoteller, operable in response to commands from said processor to print an audit slip, said processor being coupled to detect initiation of internal access for service by service personnel and being operable in response thereto to command said printer to provide to said service personnel a first audit slip indicative of the state of said continuous audit immediately prior to said service, said processor being operable thereafter to command said printer to provide to said service personnel a second audit slip indicative of the state of said continuous audit immediately after said service, said first and second audit slips being operative to provide tangible accountability for said service personnel.

From a third aspect, the present invention consists in a system according to the second aspect comprising a keyboard internal to said autoteller, said processor being operable, in the course of said service, to provide indication to said service personnel that a password entry is required on said keyboard, said processor being coupled to monitor said keyboard and being operable, in response to entry of a first predetermined password, to perform a bank service routine wherein totals in said continuous audit are selectably alterable, said processor being operable in response to entry of a second predetermined password to perform a third party service routine wherein said totals are not selectably alterable, and said processor being operable in response to failure to enter either said first predetermined password or said second predetermined password in less than a predetermined number of tries within a predetermined period to shut down further operation of said autoteller and to provide an external alarm.

BRIEF DESCRIPTION OF THE PREFERRED EMBODIMENT

In a preferred embodiment there is provided a cassette with an opening mechanism. The opening mechanism is operable to open a door to provide access by a banknote dispenser to a supply of banknotes within the cassette. The operating mechanism comprises an opening bar preferably manually operable to open the door. The cassette is placed on a ramp in the banknote dispenser in the autoteller. The banknote dispenser comprises a key assembly holding a captive key and movable to present the captive key to a lock on the cassette. The lock prevents movement of the operating bar until placed in an open state by insertion and rotation of the key. The captive key is preferably shrouded to prevent access thereto. When the lock mechanism is placed in an open state, the operating bar can be raised to open a primary door allowing access to the supply of banknotes. Thereafter the operating bar can be folded to engage a secondary door opening bar which has the function of opening both a secondary door to allow complete access to the banknote dispenser to the supply of banknotes and a reject door to allow rejected banknotes to be placed by the banknote dispenser back into the cassette.

The cassette comprises a tilt sensor. The tilt sensor comprises a blocking bar free to rotate under the influence of gravity about a blocking bar pivot. The operating bar comprises a notch. When the cassette is on the ramp the blocking bar rests against a blocking bar rest pin. In this position the blocking bar does not engage the notch. The key assembly is such that in order to present the cassette to the key without the cassette being on the ramp the cassette must be inverted. In this inverted position the blocking bar falls into the notch on the operating bar and prevents the opening bar being operated despite the lock being opened.

In a second preferred embodiment, a second blocking bar is provided on the other side from the first blocking bar of the operating bar operating in a similar manner and providing an even narrower range of angles whereat the cassette may be opened.

In conjunction with the cassette in either of its first and second preferred embodiments, there is provided a processor within the autoteller which senses when the autoteller is accessed for service and provides the service personnel with a first audit slip indicative of the financial state of the autoteller immediately prior to service and thereafter with a second audit slip indicative of the financial state of the autoteller immediately after service. These two slips are retained by the service personnel and can be used to indicate any losses by the autoteller. The slips over a period of time will indicate any consistently high loss rates and will therefore indicate any personnel who engage in minor pilferage.

In the preferred embodiment of the present system the autoteller comprises a keyboard internal to itself and accessible to third party service personnel. When the autoteller is accessed for servicing, the processor requests, either via the printer or a monitor, that a password be entered. The autoteller is provided with two classes of password. A first class of password is a bank service password whereby the keyboard may be used to update information in a continuous audit. The second kind of password is the third party service password where no access to alter information in the continuous audit is available. The processor, having requested the entry of a password, starts a timing operation. If the person having access to the autoteller does not enter one or other of the two passwords within a predetermined number of tries before the timing operation is complete the processor in the autoteller shuts down the autoteller and provides an alarm. The alarm may be local or may be sent via data communications to a remote point.

BRIEF DESCRIPTION OF THE DRAWINGS

The invention is further explained, by way of an example, by the following description in conjunction with the appended drawings in which.

DETAILED DESCRIPTION OF THE PREFERRED EMBODIMENT

Figure 1:
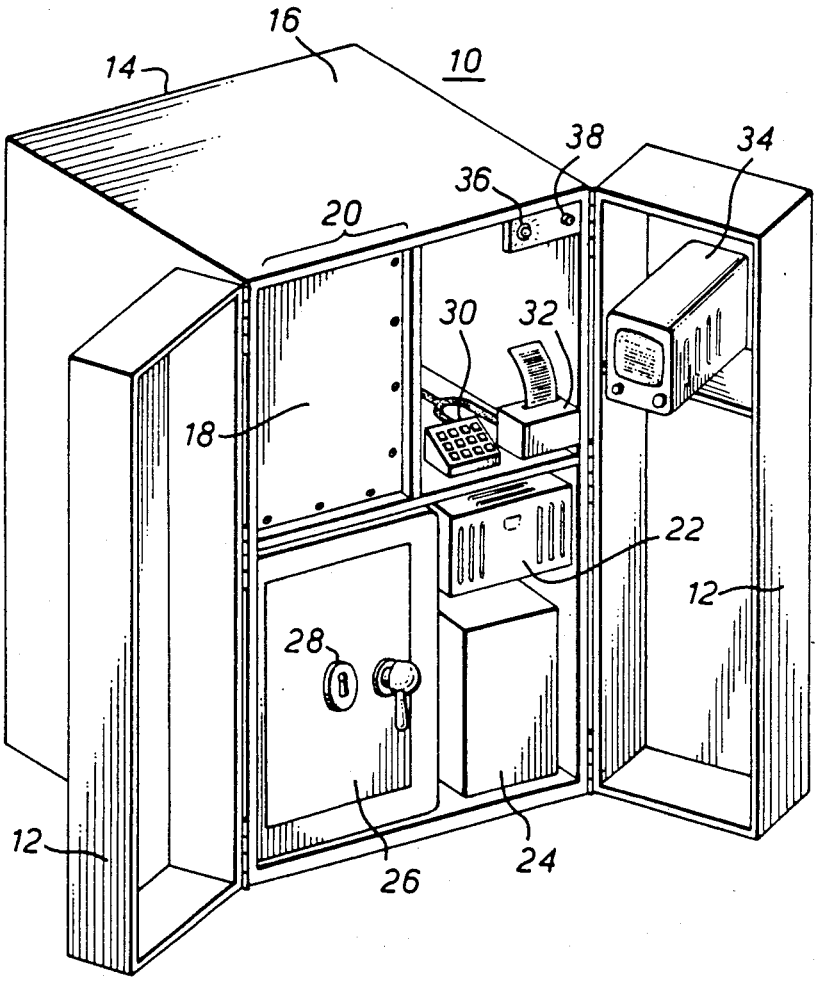
FIG. 1 shows a projected view of an autoteller, open for service, embodying the present invention.

FIG. 1 shows an autoteller 10 comprising a pair of rear doors 12 open to provide access for service personnel to replenish and attend to the autoteller 10. The front face 14 of the autoteller 10 protrudes through the wall of a bank to present a service console to members of the public for use when the bank may be closed. The autoteller 10 is housed in a robust steel case 16. The case 16 is divided into compartments. A processor 18 is housed within a secure compartment 20 to which access is only possible using special tools. The steel case 16 further houses a disk drive 22 for use by the processor 18, a deposit receiving box 24 for receiving deposits from autoteller users, and a safe 26 for holding a supply of banknotes to be dispensed to customers. The safe 26 is opened using a conventional safe lock 28, the key for which is provided to the service personnel.

An internal keypad 30 is provided for communicating with the processor 18. In its turn, the processor 18 controls an internal printer 32. The processor 18 further controls an internal monitor 34 for communicating with service personnel. The internal keypad, the internal printer and the internal monitor are in addition to any keyboards, printers and monitors associated with normal customer access to the autoteller 10 and known in the art. The internal monitor 34 is mounted within one of the rear doors 12 for convenience. In addition to the features so far described, the autoteller comprises a warning light 36 and deactivation button 38. Whenever the rear doors 12 are opened the processor 18 senses the opening of the doors 12 and lights the warning light 36. The person gaining access to the autoteller 10 must press the deactivation button 38 within a predetermined period or the processor 18 powers down the autoteller and activates an alarm. The alarm can either be a local audible or visual alarm or the alarm may be given via remote telecommunications at a remote point. The processor 18 can sense the opening of the doors 12 by means of a microswitch or similar device.

Figure 2:
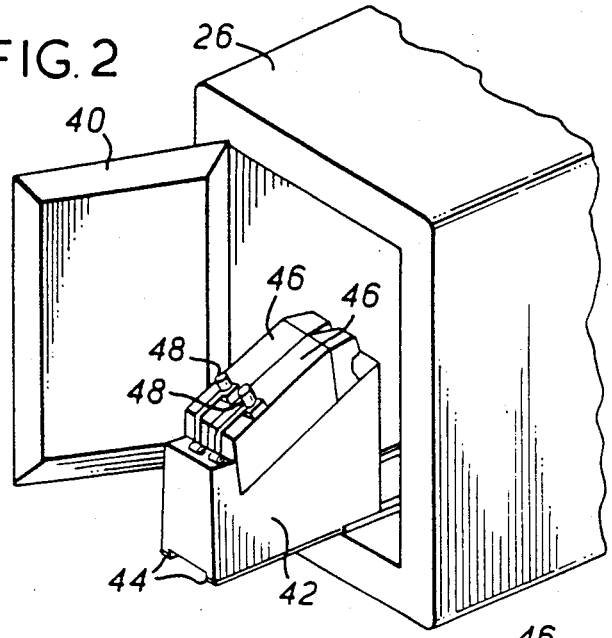
FIG. 2 shows the safe assembly in the autoteller of FIG. 1 in an open position and further shows details of the cassette supporting ramp therein slid out into an access position and supporting a pair of banknote cassettes.

FIG. 2 shows a projected view of the safe 26 of FIG. 1 in an open position. The safe door 40 is shown in an open position. Within the safe 26 is housed the banknote dispensing apparatus. The banknote dispensing apparatus comprises a cassette mounting ramp 42 which can be slid out from the safe 26 captive on runners 44 for exchange of any one of a plurality of cassettes 46. The cassettes 46 are lockable cassettes and are mounted side by side on the ramp 42. As will later be described, the ramp 42 comprises key assemblies 48, one for each cassette 46 to be held in the ramp. While in FIG. 2 only two cassettes are shown held in the ramp 42, it is to be understood that the dimensions of the safe 26 and of the ramp 42 can be varied to accommodate as many cassettes 46 as are desired for operation of the autoteller 10.

Figure 3:
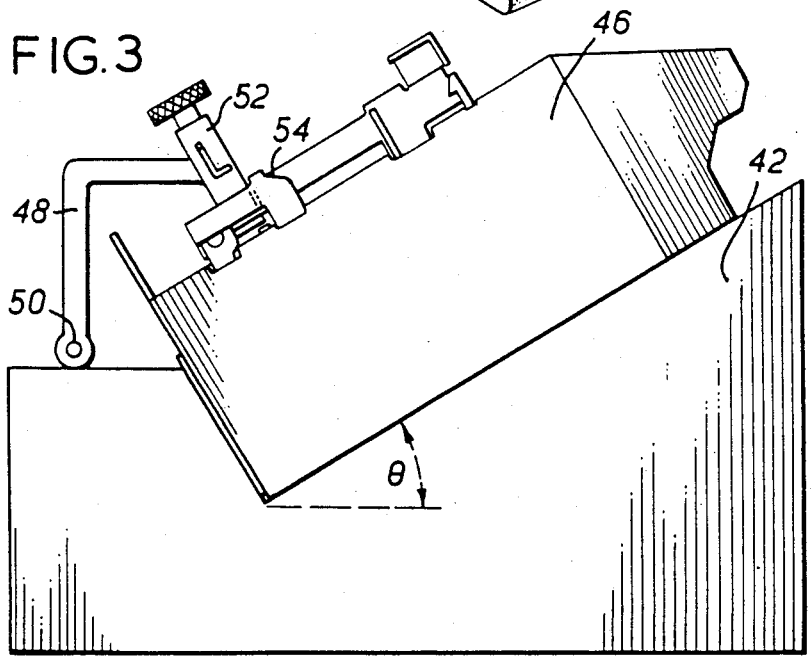
FIG. 3 shows a side view of a cassette supported on the ramp of FIG. 2 with the key assembly engaging the lock on the cassette.

FIG. 3 shows a side view of the ramp 42 of FIG. 2 with a cassette 46 mounted thereon. The cassette 46 is held on the ramp 42 at an angle $\theta$ to the horizontal. In the preferred embodiment here shown the angle $\theta$ is chosen to be 30°. It is to be appreciated that this angle may be more or less than 30° according to the desire of the particular designer.

When the cassette 46 is in the ramp 42, the key assembly 48 can be swung about key assembly pivot 50 with which it is affixed to the ramp 42 for a shrouded key 52 to engage a lock assembly 54 on the cassette 46. The shrouded key 52 can open the lock 54 and there is a different shrouded key for each cassette 46 which can be held on the ramp 42. By selecting a different shrouded key 52 for each cassette 46 a cassette may be opened only in a predetermined position on the ramp. Just as the cassettes 46 may be placed side by side on the ramp 42, so the individual key assemblies 48 are spaced out along the ramp 42. The cassettes 46 are pre-loaded with different denominations of banknotes. By arranging that each cassette 46 is opened with a different shrouded key 52 it is provided that one denomination of banknote will not be dispensed from a position allocated to another. In this manner erroneous operation of the autoteller 10 is avoided.

While not shown in the drawings or further described, it is to be understood that the ramp 42 contains part of a banknote conveyor mechanism for extracting banknotes one by one from each cassette 46 for transfer to the front face 14 of the autoteller 10 to be given to a customer on request.

Figure 4:
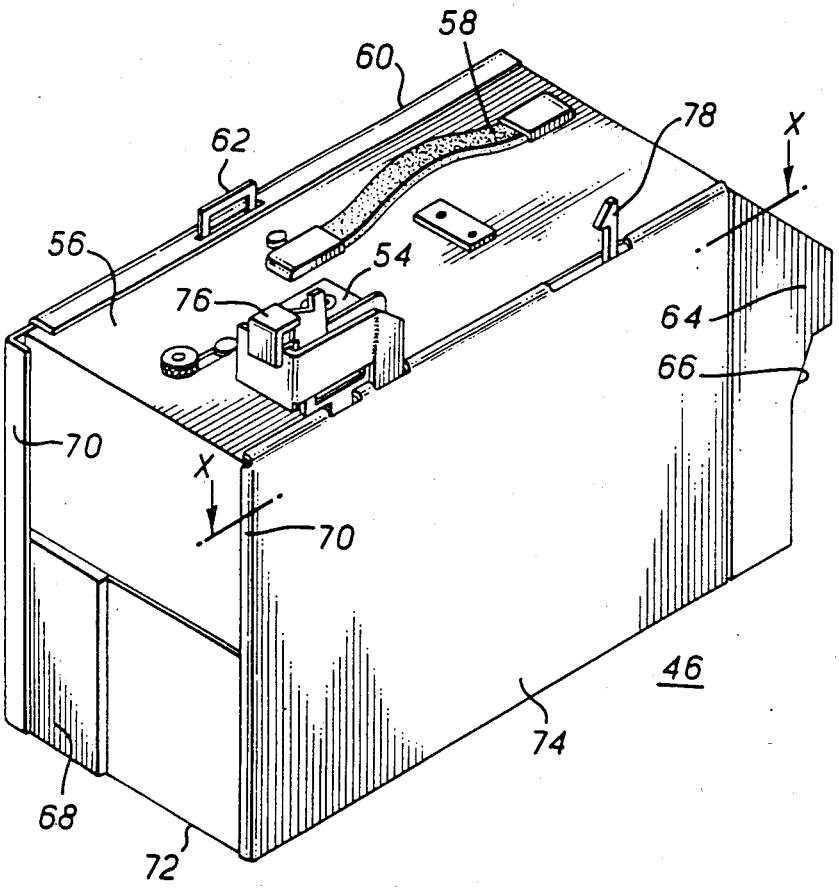
FIG. 4 shows a projected view of a closed cassette.

FIG. 4 shows a projected view of the cassette 46 shown in FIGS. 2 and 3. The cassette comprises a steel cassette case 56 transportable by means of a handle 58. A side door 60 is openable to allow access to the interior of the cassette 46 for replenishing the supply of banknotes. A spring-loaded hasp 62 passes through an aperture in the top of the side door 60 and can be secured by a conventional padlock after closure of the side door 60. The cassette 46 comprises a rear section 64 for receiving rejected banknotes. If a banknote does not pass one of numerous tests on its way to being dispensed to the customer, or is crumpled or for some other reason not handled by the banknote dispenser, it is returned via an ancillary conveyor to be kept in the rear section 64 of the cassette 46. The rear section 64 is divided off from the main body of the cassette by a spring loaded plate. In maintaining an audit of the autoteller, the processor keeps a track of the number and kind of reject notes which should be in the rear section 64 of the cassette 46.

The rear section 64 of the cassette 46 is provided with a reject banknote door not specifically illustrated in FIG. 4, but whose general position is indicated. The cassette 46 further comprises a primary door 68 which is held by slides 70 constrained to slide in a vertical direction as shown in FIG. 4 to expose the external stack of banknotes for the banknote dispenser in the ramp 42 to gain access. The cassette 46 yet further comprises a secondary door 72 on the lower surface thereof immediately adjacent to the primary door 68 and slideably openable when the primary door 68 is open to provide access to the common corner between the primary door 68 and the secondary door 72 for proper operation of the banknote dispensing conveyor belts within the ramp 42. Once again, in FIG. 4 the secondary door 72 is not specifically illustrated but its position approximate to the lower edge of the primary door 68 is indicated.

The cassette comprises a side cover 74 for concealing a door opening mechanism. The door opening mechanism comprises a manually-operable grip 76 held approximately to the lock assembly 54 by which an operator may open the doors. A spring-loaded catch 78 is used in a manner to be explained at a later stage for maintaining the opening mechanism in an open state. The lock assembly 54 is provided with a guard for preventing forceable entry into the space between the steel cassette case 56 and the side cover 74.

Figure 5A:
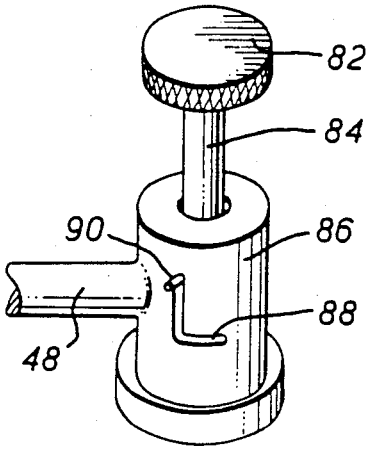
FIGS. 5A to 5C show three stages in the operation of the shrouded key in the key assembly in FIG. 3.
Figure 5B:
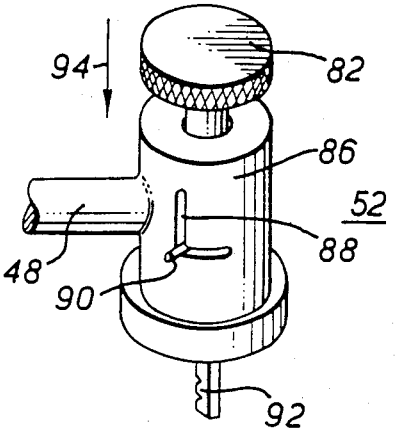
Figure 5C:
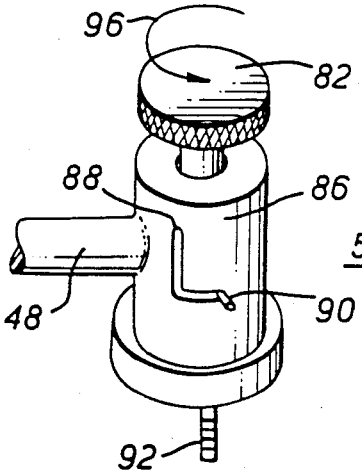

FIGS. 5A to 5C show the shrouded key 52 of FIG. 3 in its various stages of operation. FIG. 5A shows the key assembly 48 just presented to the lock 54 with the shrouded key 52 in its fully open position. The shrouded key 52 comprises a spring-loaded plunger 82, atop a depressable shaft 84 gaining entry through an aperture into a key shroud 86. The key shroud 86 comprises a guide slot 88 wherein a guide pin 90 slides. The guide slot 88 is L-shaped and defines the path of the depressable spring-loaded plunger 82. FIG. 5A shows the fully open position of the shrouded key 52 with the guide pin 90 at the top-most portion of the guide slot 88.

In FIG. 5B, a key 92 has been inserted into the lock 54 by means of depressing the plunger 82 in the direction indicated by the arrow 94. The guide pin 90 is shown at the bottom left-most portion of the guide slot 88. While FIG. 5B and FIG. 5C show the key 92 being exposed beneath the key shroud 86, it is to be appreciated that in operation the key 92 would be contained within the lock 54. FIG. 5C shows the last stage of operation of the shrouded key assembly 52. The plunger 82 is rotated as indicated by the rotary arrow 96 for the key 92 to be rotated in the lock assembly 54 to open the lock. The guide pin 90 moves from the common point of the two portions of the L-shaped guide slot 88 to the lower extremity indicated in FIG. 5C. The key 92 is thus maintained in a position to keep the lock 54 open.

The lock assembly 54 shown in FIG. 4 is of a type from which the key 92 cannot be withdrawn unless the lock is placed once more in the locked state. Thus, in the position shown in FIG. 5C the lock 54 retains the key 92 and the key assembly 48 cannot be swung back from the cassette 46. In order the release the key assembly 48 from the cassette 46 the stages shown in FIGS. 5A to 5C must be followed in reverse. Only when the key is at the angle shown in FIG. 5B may the key 92 be withdrawn from the lock 54.

The key 92, being a captive key and being shrouded, makes it difficult to copy the key.

Figure 6:
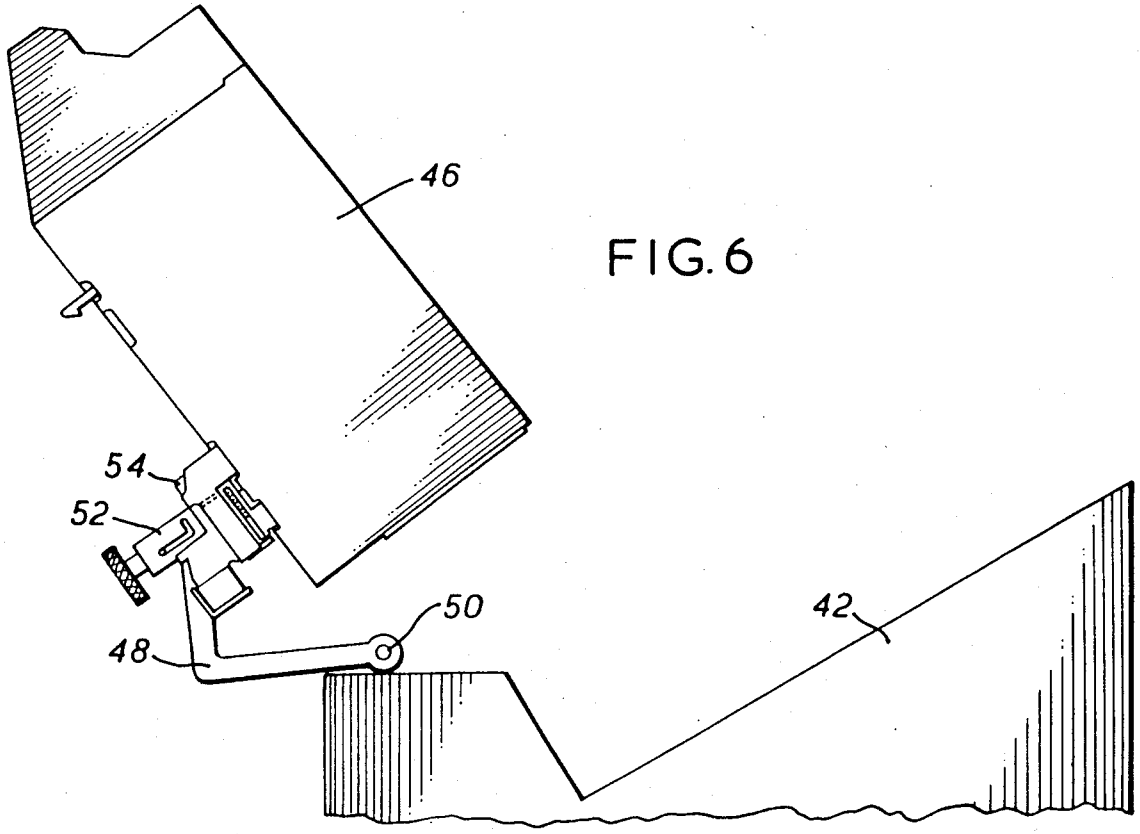
FIG. 6 shows the alternative position whereat the key assembly of FIGS. 3 and 5 may be made to engage the lock on a cassette.

FIG. 6 shows the manner in which the cassette 46 is presentable to the shrouded key 52 when not on the ramp 42. It is to be appreciated that this position is one where service personnel of felonious intent would be forced to place the cassette 46 in an effort to gain access to its interior without the cassette being on the ramp 42. When the cassette 46 is open on the ramp 42 external access to its interior is prevented by the structure of the ramp. Thus, it is necessary to resort to the position shown in FIG. 6 to present the key 92 to the lock assembly 54. The key assembly 48 is rotated about the key assembly pivot 50 for the cassette 46 to be substantially inverted upon its presentation to the shrouded key. The position as shown in FIG. 6 is at an extremity of counter-clockwise movement. It is to be appreciated that there exists a range of angles for the key assembly 48 of the pivot 50 whereat the cassette 46 may gain access to the shrouded key 52. As will be described later, the range of angles to the horizontal, whereat the cassette 46 may be presented to the shrouded key 52 while not on the ramp 42, is chosen such that a tilt sensor, to be later described, prevents opening of the cassette 46.

Figure 7:
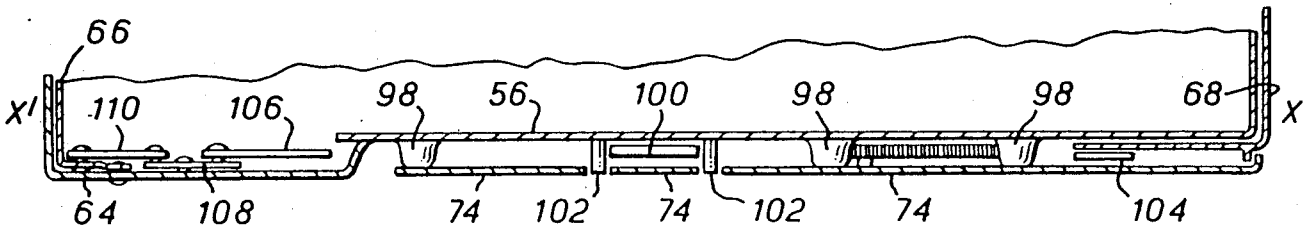
FIG. 7 shows a cross-sectional view through the opening mechanism of the cassette of FIG. 4 along the line X—X' viewed in the direction of the arrows.

FIG. 7 shows a cross sectional view of the opening mechanism contained between the steel cassette case 56 and the side cover 74 viewed along the line X—X' shown in FIG. 4. The side cover 74 is held apart from the adjacent steel cassette case 56 by means of bosses 98 on the steel cassette case 56. The side cover 74 is affixed to the steel cassette case 56 by means of screw threads in the bosses 98. The bosses 98 are formed in the steel case 56 by pressing.

A secondary door opening bar 100 is constrained to slide in a vertical direction as viewed in FIG. 4 by means of entrapment between the side cover 74, the steel case 56 and a pair of guide pegs 102. A door operating bar 104 atop which the grip 76 is mounted is mechanically coupled to the primary door 68 such that as the door operating bar 104 slides in a vertical direction as shown in FIG. 4, so the primary door 68 is opened. The secondary door opening bar 100 has the function of opening the secondary door 72 and further of opening the reject banknote door 66 in a manner to be later described. The vertical movement as seen in FIG. 4 of the secondary door opening bar 100 is coupled in a manner to be explained to a reject door operating bar 106 and thereafter to a first reject door operating lever 108 and a second reject door operating lever 110 to pivot the reject door 66 to allow access to the rear section 64 of the cassette 46.

Figure 8:
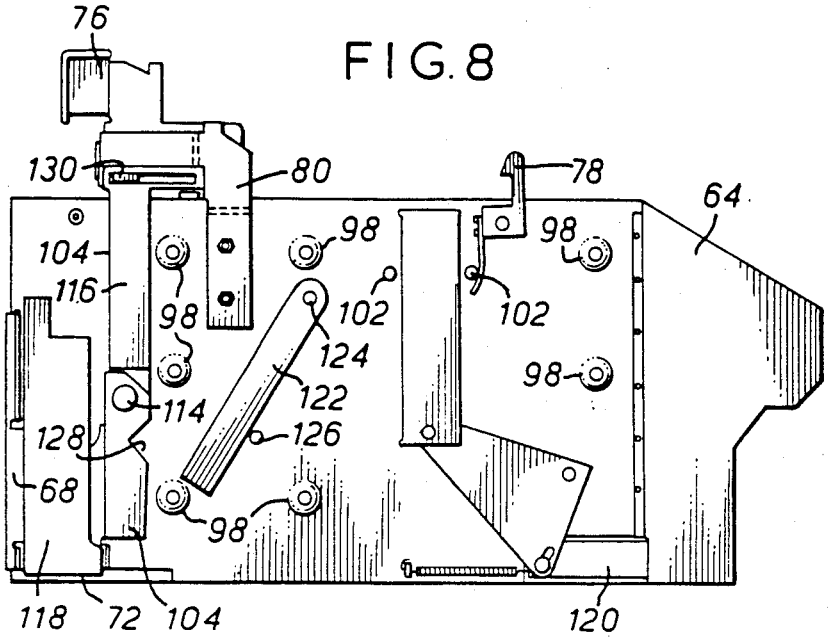
FIG. 8 shows a side elevation of the cassette of FIG. 4 with all doors closed, the side cover removed, and as the internal parts would appear when the cassette is sitting on the ramp as illustrated in FIG. 3.

FIG. 8 shows a side elevation of the cassette of FIG. 4 with the side cover 74 removed to reveal the opening mechanism.

The door operating bar 104 comprises a lower section 112 articulated by means of an opening bar pivot 114 to an upper section 116. The lower section 112 of the opening bar 104 is affixed to the primary door 68. A primary door guide plate 118 overlies the attachment between the primary door 68 and the lower section 112 of the opening bar 104 to guide the vertical ascent of the primary door 68. The primary door guide plate 118 is integral with the secondary door 72 being formed as a common metal pressing. As will be later explained, the primary door guide plate 118, the secondary door 72 and a reject door operating bar 120 are all commonly mounted upon a plate which runs the length of the floor of the cassette 46. Thus, any movement relative to the cassette of the primary door guide plate 118, the secondary door 72 and the reject door operating bar, is in common.

A blocking bar 122 is freely pivotally mounted to swing under the influence of gravity on a blocking bar pivot 124. FIG. 8 shows the blocking bar 122 in the position which it would occupy when the cassette 46 is upon the ramp 42. In this position, the blocking bar 122 rests against a blocking bar rest pin 126. The lower section 112 of the operating bar 104 comprises a notch 128 for the blocking bar 122 to occupy when the cassette is in the position shown in FIG. 6. In FIG. 8 the door operating bar 104 is free to be moved in a vertical direction as indicated by virtue of the fact that the blocking bar 122 does not engage the notch 128.

Figure 9:
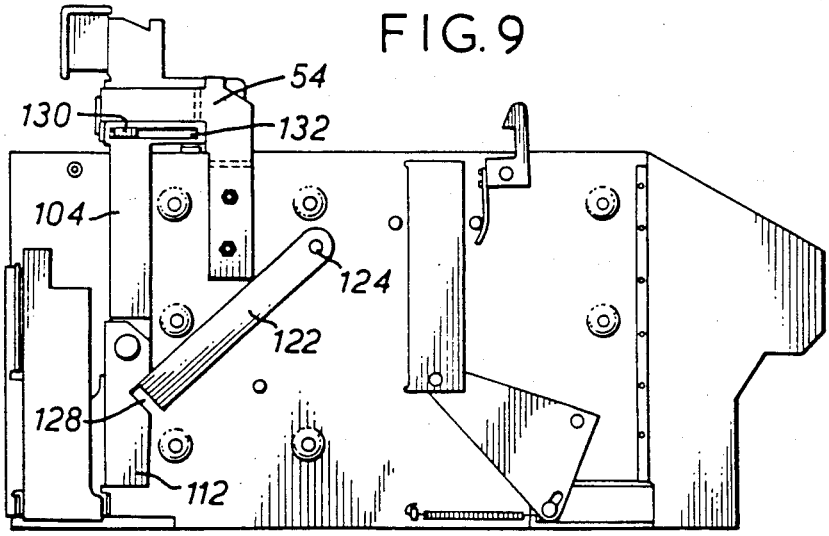
FIG. 9 shows a side elevation of the cassette of FIG. 4, with the side cover removed, with all doors closed, and with the internal parts of the opening mechanism disposed in a manner appropriate to the cassette being in the position shown in FIG. 6.

FIG. 9 shows the elements of FIG. 8 with the blocking bar 122 in the position it would occupy with the cassette 46 as shown in FIG. 6. The blocking bar 122 engages the notch 128. Any attempt to raise the door operating bar in a vertical direction in order, as will later be explained, to open the doors of the cassette 46, is resisted by the notch 128 of the lower portion 112 of the door operating bar 104 engaging the blocking bar 122. The blocking bar 122 generates reactive forces against the blocking bar pivot 124. When the lock assembly 54 is in the locked position a tongue 130 passes through an aperture 132 in the door operating bar 104 to prevent its vertical movement. When the lock 54 is open, the tongue 130 no longer prevents vertical movement of the door operating bar 104, but if the cassette 46 is in an incorrect attitude with the lock open, the blocking bar 122 takes over the function of the lock 54 and prevents movement of the door operating bar 104.

Figure 10:
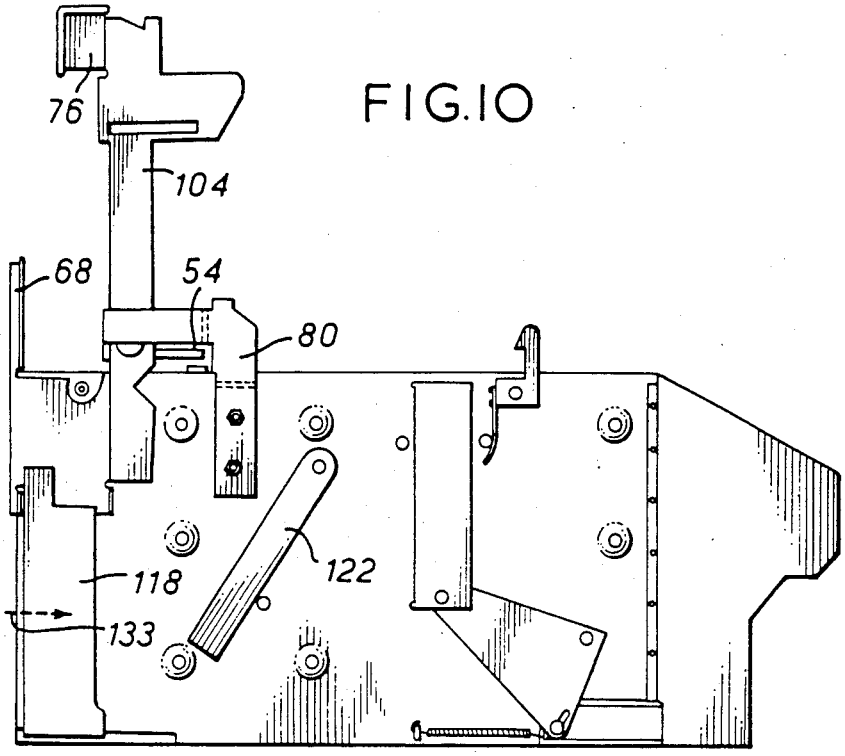
FIG. 10 shows the first stage of opening of the cassette opening mechanism pursuant upon an initial position as shown in FIG. 8, FIG. 10 illustrating the opening of the primary door.

FIG. 10 shows the first stage of opening of the cassette 46. It is to be understood with regard to FIG. 10 that it is assumed that the lock 54 has been opened and that the cassette 46 is on the ramp 42 such that the blocking bar 122 does not interfere with operation. The door operating bar 104 is raised beneath the guard 80 by means of the grip 76 to an upper position carrying with it the primary door 68 beneath the primary door guide plate 118 allowing access to the interior of the cassette 46 as indicated by the arrow 133.

Figure 11:
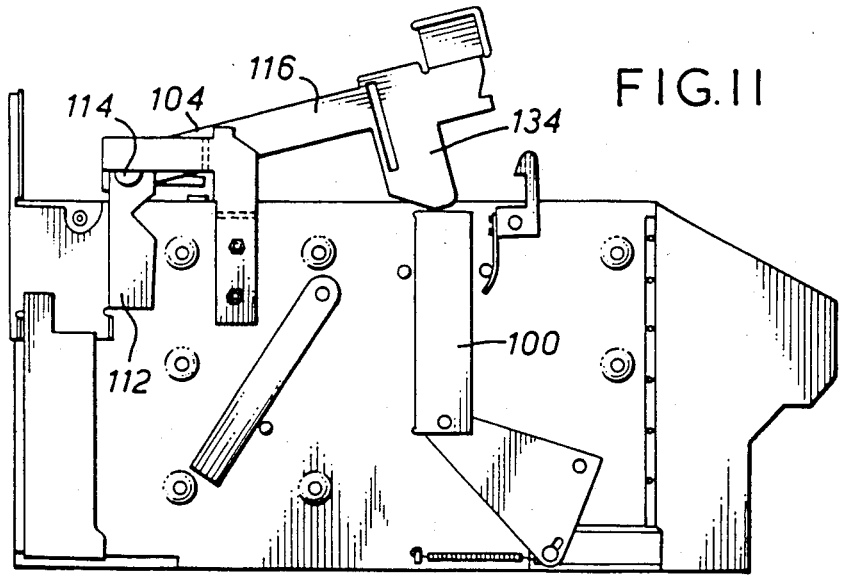
FIG. 11 shows the second stage of operation of the opening mechanism subsequent to the position shown in FIG. 10.

FIG. 11 shows the second stage of opening the doors of the cassette 46 to gain access. The upper section 116 of the door operating bar 104 is rotated about the opening bar pivot 114 for a secondary door opening projection 134 to engage the secondary door opening bar 100 otherwise shown in FIG. 7.

Figure 12:
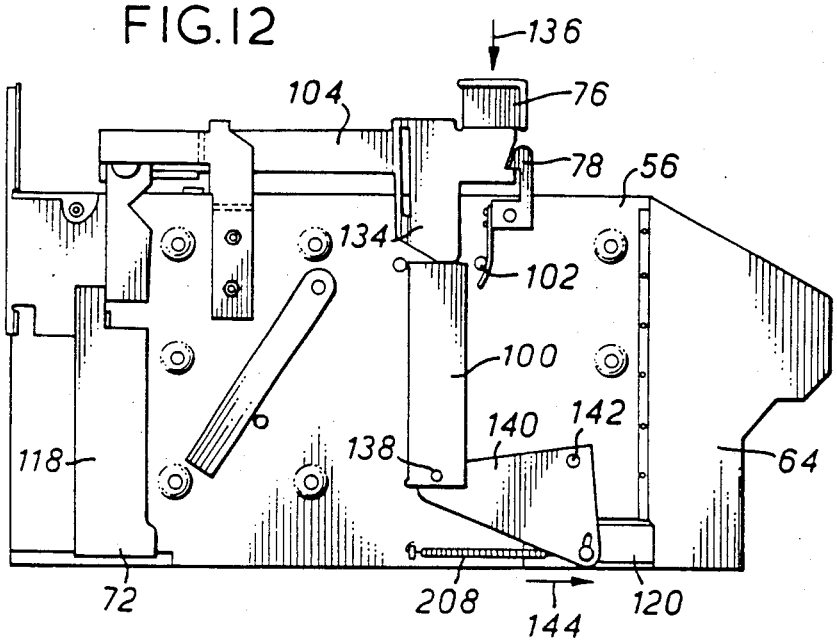
FIG. 12 shows the third stage of operation of the opening mechanism subsequent to the position shown in FIG. 11, FIG. 12 illustrating a stage whereat the secondary door and the reject door of the cassette are opened.

FIG. 12 shows the last stage in operation of the doors of the cassette 46 to provide access to the interior thereof. The grip 76 is depressed as indicated by the arrow 136 for the secondary door opening projection 134 to push down the secondary door opening bar 100. The secondary door opening bar 100 is affixed by a captive pivot 138 at its lower end to a secondary door operating plate 140. The secondary door operating plate 140 is held by a captive pivot to the steel case 56 of the cassette 46. The secondary door operating plate 140 is further pivotally affixed to the reject door operating bar 120. As the secondary door operating bar 100 is depressed so the secondary door operating plate 140 is rotated about its pivotal mounting 142 onto the steel case 56 for the portion thereof pivotally attached to the reject door operating bar 120 to force the reject door operating bar 120 towards the rear portion 64 of the cassette 46. At its lowest point of depression the door operating bar 104 engages the catch 78, in turn affixed to the steel case 56 and spring-loaded against one of the guide pegs 102 to maintain the door operating bar 104 in the position whereat the secondary door opening bar 100 is depressed.

In being urged towards the rear portion 64 of the cassette 46 as indicated by the arrow 144, the reject door operating bar 120, by virtue of being coupled thereto by means of the plate earlier described running the length of the floor of the cassette 46, carries with it the primary door guide plate 118 and the secondary door 72. The position shown in FIG. 12 is, therefore, one of completion of the opening of the cassette 46.

Figure 13:
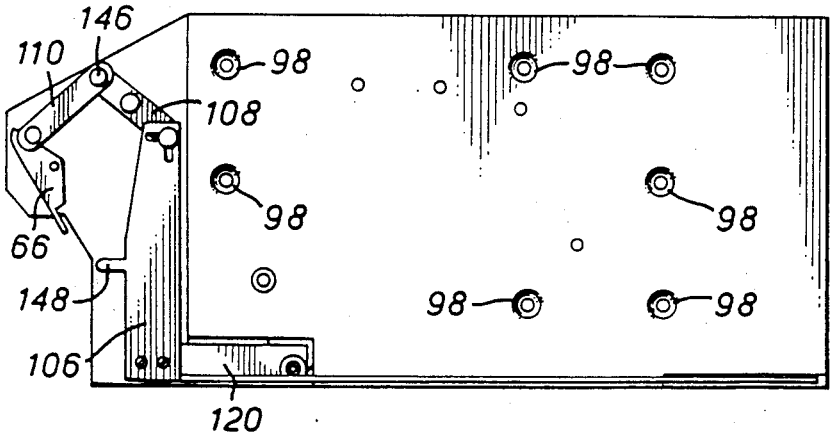
FIG. 13 shows the view from within the cassette looking towards the opening mechanism when neither the secondary door nor the reject door is opened, the position shown in FIG. 13 being appropriate to each of FIGS. 8, 9, 10 and 11.

FIG. 13 shows a view from the inside of the cassette 46 corresponding to the positions of the opening mechanism shown in FIGS. 8, 9, 10 and 11. That is to say, FIG. 13 shows the position before the secondary door opening bar 100 is depressed by the secondary door opening projection 134.

The reject door operating bar 120 passes into the interior of the cassette 46 and is affixed to the reject door operating plate 106. The reject door operating plate 106 is in slotted pivotal engagement with the first reject door operating lever 108. The first reject door operating lever 108 is provided with a fixed pivot 146 onto the interior of the steel case 56. The first reject door operating lever 108 is pivotally engaged with the second reject door operating lever 110 which in turn pivotally engages the reject banknote door 66. The reject banknote door 66 is pivoted on either side of the cassette 46 onto the steel case 56.

The reject door operating plate 106 comprises an indicator flag 148 for indicating when the cassette 46 has been opened, the indicator flag 148 being detectable by the processor 18.

All the elements of FIG. 13 are previously shown in FIG. 7 save for the indicator flag 148.

Figure 14:
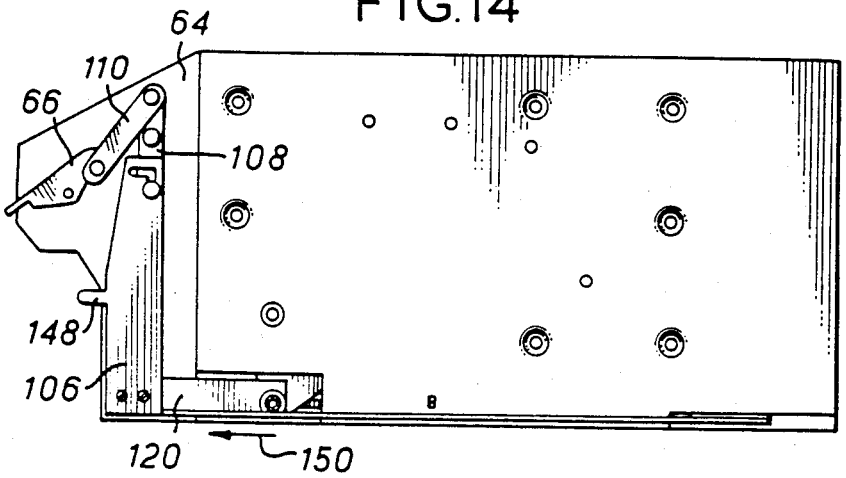
FIG. 14 shows the view of FIG. 13 where both the secondary door and the reject door have been opened, this view being appropriate to the position of the opening mechanism illustrated in FIG. 12.

FIG. 14 shows the position of the elements of FIG. 13 subsequently to the depression of the secondary door opening bar 100. The reject door operating bar 120 is urged towards the rear section 64 of the cassette 46 as indicated by the arrow 150. The reject door operating plate 106 rotates the first reject door operating lever 108 which in turn draws back the second reject door operating lever 110 which rotates the pivotally mounted reject banknote door 66 into an open position. At the same time, the indicator flag 148 projects from the cassette 46 and is sensed by a photosensor, microswitch or the like, to provide indication to the processor 18 that a new cassette has been inserted into the autoteller 10.

Figure 15:
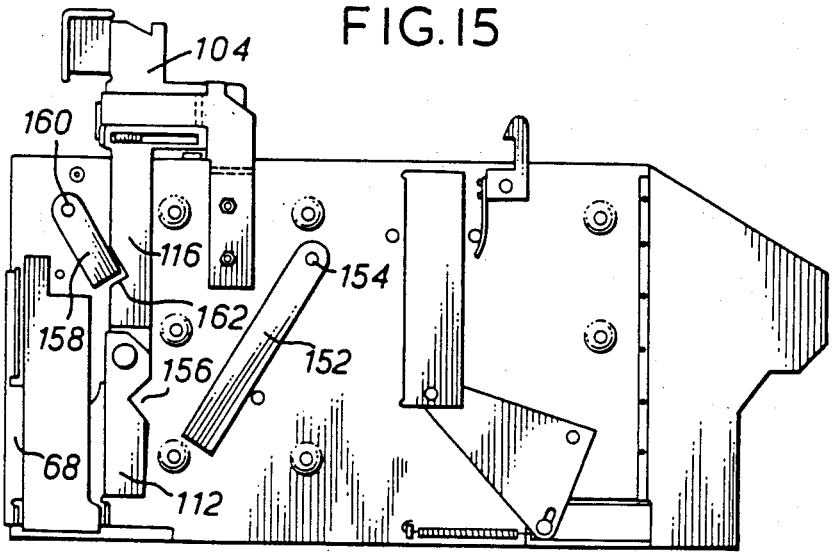
FIG. 15 shows a modification over the first preferred embodiment illustrated in FIGS. 8 and 9 wherein a second blocking bar is provided on the other side of the opening bar engaging a second notch in the operating bar further to restrict the range of angles to the horizontal whereat the cassette may be opened.

FIG. 15 shows a preferred refinement of the opening mechanism previously described. An additional blocking bar is provided. A first blocking bar 152 swings on a first blocking bar pivot 154 and can engage a first blocking bar notch 156 on the lower section 112 of the door operating bar 104. A second blocking bar 158 is free to swing on a second blocking bar pivot 160 to engage a second blocking bar notch 162 on the upper section 116 of the door operating bar 104. When the cassette 46 is at an incorrect angle, one or other of the first or second blocking bars 152, 158 will engage their respective notches 156, 162 to prevent movement of the door operating bar 104. When the cassette 46 is in the correct position neither of the first or second blocking bars 152, 158 will engage the door operating bar 104 and the cassette can be opened. The arrangement shown in FIG. 15 represents a refinement over that shown in the previous figures by providing for the provision of a smaller range of angles to the horizontal over which the cassette 46 may be operated.

With regard to the second blocking bar 158, it is arranged that the conjunction between the lower section 112 of the door operating bar and the primary door 68 passes thereover as the door operating bar 104 is raised.

Figure 16:
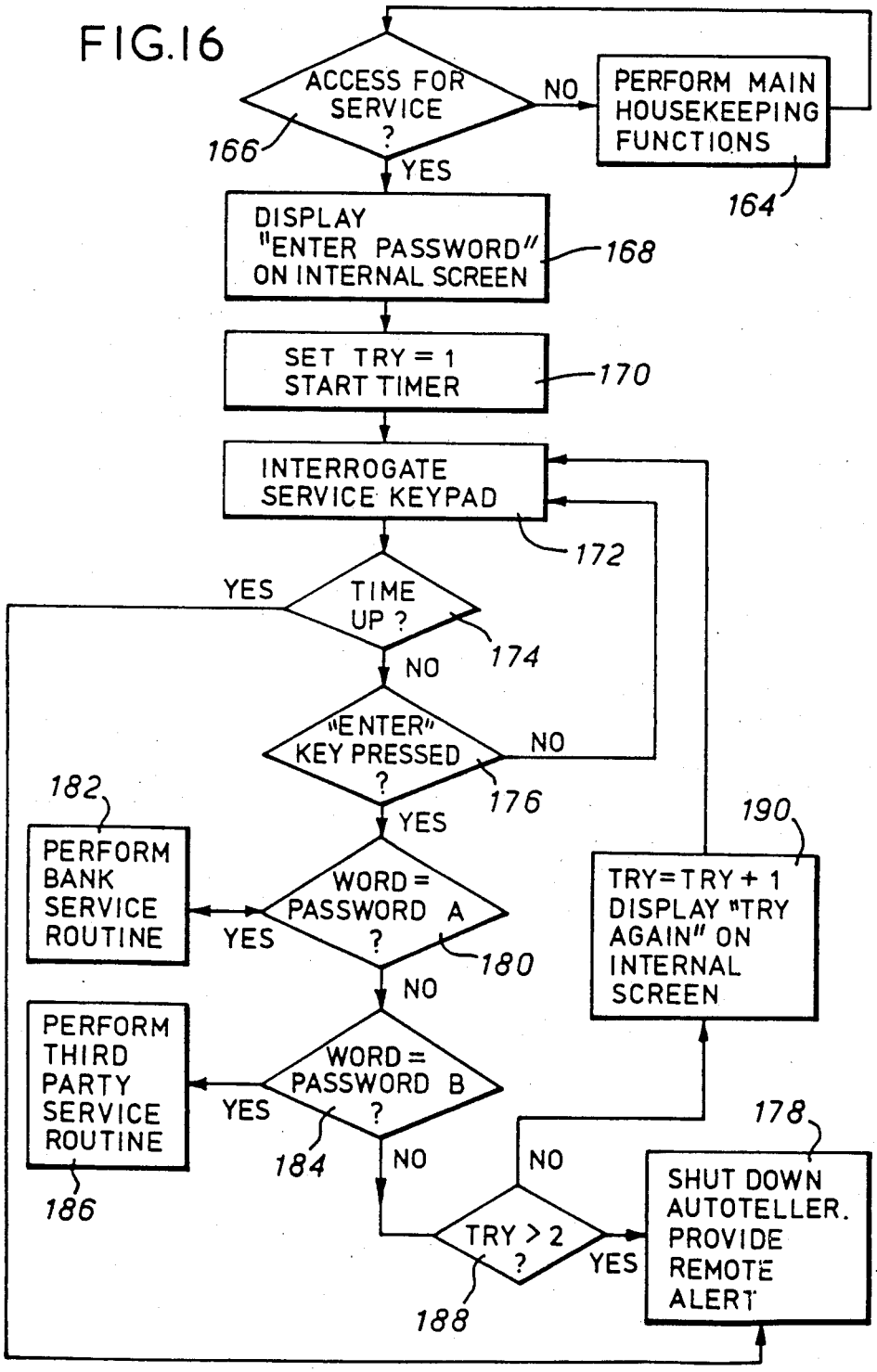
FIG. 16 is a flow chart illustrating the operation of the processor in the autoteller whereby the processor receives and identifies one or other of the types of password and, in default thereof, terminates autoteller operation and sounds an alarm.

FIG. 16 shows a flow chart of the operation of the processor 18 both in running the autoteller 10 and in attending to servicing.

In a first operation 164 the processor 18 maintains the functions of the autoteller 10. This involves detecting any malfunctions, attending to the needs of customers and communicating with any remote data processing system. Within the first operation or housekeeping function 164, there is provided a first test 166 regularly and repeatedly applied for detecting access for service. In the first test the monitor 18 continuously scans an input port driven by a microswitch for detecting if the rear doors 12 have been opened. If the rear doors 12 have been opened, the processor 18 commands the light 36 to be illuminated and starts a timing operation. If a button 38 is not pressed within a predetermined time the processor 18 shuts down and provides a local and/or remote alarm. If the button 38 is pressed within the predetermined time the processor 18 moves to a second operation 168. If the rear doors 12 have not been opened, the processor 18 returns to perform the housekeeping functions of the first operation 164. It is to be appreciated that detection of an impending service for the autoteller 10 may be achieved in other ways. The manner hereinbefore described is illustrative of one manner of such detection.

In the second operation 168 the processor 18 displays a message for the service personnel on the internal monitor 34 indicating that the service personnel should now enter the appropriate password on the internal keypad 30. As well as being provided with keys for entry to the autoteller, the service personnel are provided with a password appropriate to their intended function. Only legitimate service personnel will know the password which is otherwise kept secret and can be changed whenever necessary either on a regular basis or in response to detected breach of security.

After performing the second operation 168, the processor 18 passes to a third operation 170 where it begins a count of the number of attempts that have been made to enter a password on the internal keypad 30 and further starts a timing operation for detecting the termination of a predetermined period.

Having executed the third operation 170, the processor 18 passes to a fourth operation 172 wherein the processor 18 interrogates the internal keypad 30 to accept digits therefrom entered by the service personnel.

The processor 18 enters a loop consisting in the fourth operation 172 in combination with a second test 174 and a third test 176. The processor passes from the fourth operation 172 accepting digits from the internal keypad 30 to the second test 174 where the processor monitors whether the timing operation started in the third operation 170 has terminated. If the timing operation started in the third operation 170 has terminated the processor 18 passes immediately from the second test 174 to a fifth, shutdown operation 178, where the processor 18 disables all further operation of the autoteller 10 and provides an alarm signal. The alarm signal may be local and of an audible or visual nature. Equally, the alarm can be given at a remote point by whatever telecommunication link is available to the processor 18.

If in the second test 174 the timing operation started in the third operation 170 has not terminated the processor 18 passes to a third test 176 wherein it detects whether or not the "ENTER" key on the internal keypad 30 has been pressed. If the "ENTER" key has not been pressed the service personnel have not completed entering the password. The processor 18 therefore passes from the third test 176 back to the fourth operation 172 to complete the loop. If the "ENTER" key has been pressed it is indicative of the service personnel having completed password entry and the processor passes from the third test 176 to a fourth test 180.

In the fourth test 180 the processor 18 tests the entered password from the internal keypad 30 to see if it belongs to a first class of password. While in the fourth test 180 a single first password A is indicated, it is to be understood that the single password is representative of the testing of the entered password to see if it is in one of a first group. This first single or group of passwords is issued to bank personnel only of a trusted nature. Entry of a password from the first group A indicates that the service personnel should be allowed major and extensive access to data contained within the processor 18. If the fourth test 180 detects that the entered password is of the first type A, the processor 18 passes from the fourth test 180 to a sixth operation 182 which performs a bank service routine. In the bank service routine the processor displays on the internal monitor 34 detailed information concerning its memory content and accepts corrections to those memory contents in response to entry from the internal keypad 30. In particular, the processor 18 maintains a continuous audit of the autoteller 10. In the bank service routine 182 access via the internal keypad 30 is allowed to alter totals within this audit. Thus, the bank service routine shown in the sixth operation 182 is capable of correcting errors in the autoteller audit. Because of the extensive access provided by the sixth operation 182 to the audit maintained by the processor 18, provision of the password of the first type A is restricted to a limited number of bank personnel who have been vetted.

If the fourth test 180 does not detect that the entered password is of the first type A the processor 18 passes from the fourth test 180 to a fifth test 184. In the fifth test 184 the processor 18 tests whether the entered password, not having been a member of the first class A, is a member of a second class B. Once again, the second class B of password may be a single password or group of passwords. If the entered password is a single password or any one of a predetermined group of passwords, the fifth test 184 detects the concurrence therebetween and passes on to a seventh operation 186 concerned with third party servicing of the autoteller 10. The seventh operation 186 is described and explained in more detail in connection with FIG. 17. The seventh operation 186 is a higher security operation in that it does not allow access to the audit maintained by the processor 18 on the autoteller 10 by direct alteration of any totals or by direct alteration of any part of the memory content of the processor 18. The password or passwords of the second class B are provided to third party service personnel who are not necessarily trusted bank employees. In general, third party service personnel will be employees of a security company or private individuals contracted to perform third party servicing. There is always a risk in using such people that some will not be honest. Access to the autoteller 10 is therefore restricted in the seventh operation 186.

If the fifth test 184 fails to find a correspondence between the entered password and a password of the second class B it is indicative of the entered password being neither in the first class A nor in the second class B. The service personnel have therefore entered an invalid password. The processor passes from the fifth test 184 to a sixth test 188. In the sixth test 188 the processor tests whether there have been more than two tries at entering the password. This relates to the count of the number of tries started in the third operation 170. If there have been more than two tries the processor 18 passes from the sixth test 188 directly to the fifth operation 178 whereat the processor 18, as earlier described, shuts down further operation of the autoteller 10 and provides an alarm signal either locally or remotely.

If the sixth test 188 does not detect that there have been more than two tries at entering the password the processor 18 passes from the sixth test 188 to an eighth operation 190. If the eighth operation 190 the processor 18 adds one to the number of tries already stored and displays a message on the internal monitor 34 to the service personnel to try once again to enter the password. Having performed the eighth operation 190, the processor 18 passes from the eighth operation 190 back to the fourth operation 172 whereat the processor 18, as earlier described, interrogates the internal keypad 30 in the loop including the second test 174 and the third test 176.

Upon termination of either the sixth operation 182 for a bank service routine or the seventh operation 186 for a third party service routine the processor 18 transfers control back to the first operation 164 for maintaining the operation of the autoteller.

Figure 17:
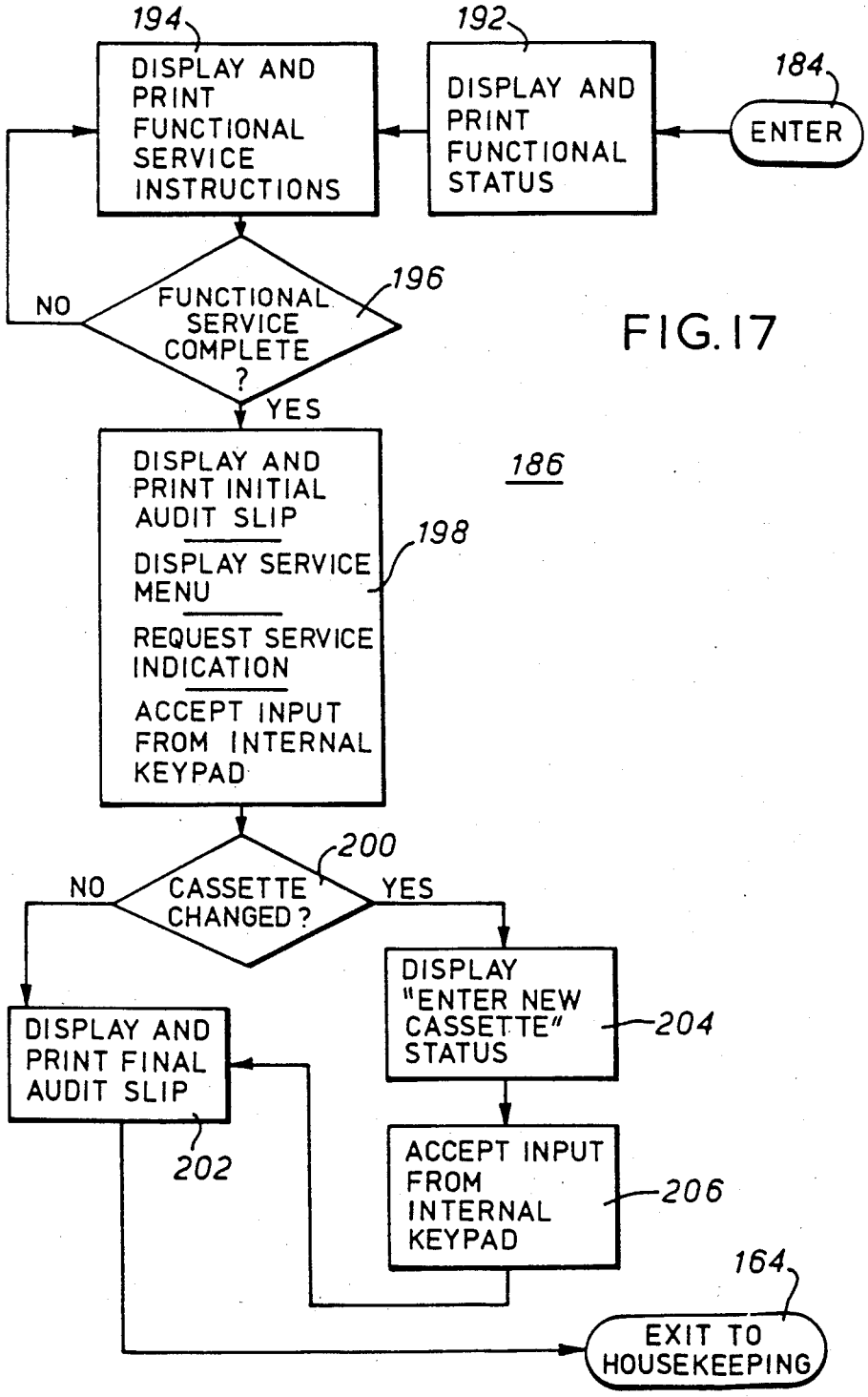
FIG. 17 is a flow chart illustrating the operation of the autoteller processor during the course of a third party service routine.

FIG. 17 shows a flow chart giving details of the third party service routine of the seventh operation 186 of FIG. 16. The third party service routine of the seventh operation 186 is entered upon successful detection of a password of the second class B by the fifth test 184. In a ninth operation 192, upon entry into the third party service routine, the processor 18 displays upon the internal monitor 34 indication of the functional status of the autoteller 10. This includes details of any jams, worn out printer tapes, and so on. Having performed the ninth 192 display operation, the processor passes to a tenth operation 194 whereat it commands the internal monitor 34 to display any service instructions for the third party service personnel. The processor 18 further commands the internal printer 32 to provide a printed slip to the third party service personnel indicative of any items requiring attention. In the final analysis, the processor 18 may decide that third party servicing is inadequate and may request that the third party service personnel summon a competent service engineer. Having displayed and printed functional service instructions in the tenth operation 194, the processor 18 performs a seventh test 196 by polling microswitches, detectors and the like to determine whether the functional service requested in the tenth operation 194 has been completed. The processor 18 in the seventh test 196 may also poll the internal keypad 30 to receive indication from the service personnel whether functional servicing is complete. The processor 18 remains in a loop bounded by the tenth operation 194 and the seventh test 196 until functional servicing is complete. At the end of functional servicing, the autoteller 10 should have all printers and dispensers operational and should have any jams cleared.

At the termination of functional servicing, the processor passes from the seventh test 196 to an eleventh operation 198. In the eleventh operation the processor 18 first commands the internal printer 32 to provide the service personnel with a first audit slip. The first audit slip represents the running audit on the operation of the autoteller 10 prior to any replenishment or removals of money. The service personnel retain the first audit slip. Thereafter the processor 18 displays a service menu to the service personnel on the internal monitor 34. The processor 18 thereafter requests via the internal monitor 34 indication from the service personnel as to what replenishment or removal service is to be provided. Thereafter the processor 18 monitors the internal keypad 30 to receive indication of what service is provided. The menu displayed includes removal and/or exchange of any of the cassettes 46 held on the ramp 42, or the removal and exchange of the deposit receiving box 24 for receiving deposits from customers.

Having received the requested input from the internal keypad 30, the processor passes from the eleventh operation 198 to an eighth test 200. The eighth test 200 monitors the input from the internal keypad and detects whether or not an operation has been performed involving exchange of cassettes or removal of the deposit box 24. It may be that no exchange operation was performed whatsoever. In that case, the processor passes from the eighth test 200 to a twelfth operation 202 wherein it displays and prints a final audit slip indicative of no exchange having been performed and substantially identical with the first audit slip provided in the eleventh operation 198. Having provided the second audit slip in the twelfth operation 202 the processor passes back to the first operation 164 for the housekeeping of the autoteller 10 as shown in FIG. 17. The twelfth operation 202 is entered directly from the eighth test 200, for example, when the deposit box 24 alone is removed. In this instance, the second audit slip will differ from the first audit slip by the amount contained within the deposit box 24.

If the processor 18 in the course of the eighth test 200 detects input from the internal keypad 30 indicative of a cassette exchange or simple removal, the processor passes from the eighth test 200 to a thirteenth operation 204. In the thirteenth operation 204 the processor 18 displays on the internal monitor 34 a request and menu for the service personnel to indicate any unusual features of the exchanged cassette. It may be that the replaced cassette is only partly full, in which case the service personnel must enter the amounts in the replacement cassette. The processor 18 accepts the revised amounts through the fourteenth operation 206 where it monitors the internal keypad 30. Having accepted the information provided by the internal keypad 30 in the fourteenth operation 206 the processor 18 passes to the twelfth operation 202 wherein the processor 18 commands the internal printer 32 to provide the second audit slip to the third party service personnel. In this instance the second audit slip contains information entered by the service personnel during the fourteeth operation 206 indicative of the amount in any replaced cassette. Having provided the second audit slip indicative of the condition of the autoteller 10 in the twelfth operation 202 the processor 18 passes back to the first operation 164 shown in FIG. 16.

The first and second audit slips provided respectively in the eleventh operation 198 and the twelfth operation 202 provide a means of detection of pilferage by third party service personnel. While a random loss or gain of banknotes in the autoteller may be expected by virtue of the manner of its operation, any persistent loss can be detected by long term consideration of the first and second audit slips. Thus, if service personnel adopt a policy of acquiring occasional banknotes, the long term statistical information on the first and second audit slips will show this characteristic and will allow further more direct checking to be made to obtain definite proof. Further, the second class of password B may be made large enough such that each service person receives his own individual password. Indication can then be provided on the audit slip as to the identity of who actually performed the service by recognition of his password. This indication of individual service personnel is a further protection against abuse.

It is to be appreciated the service personnel must be issued with a key for opening the rear doors 12 of the autoteller and further require a key to open the door 40 of the safe 26. The measures hereinbefore described, as well as preventing felonious attempts on the part of service personnel, also serve to prevent unentitled persons who, by dishonest means, may have obtained the required keys from achieving those aims which possession of the keys might otherwise lead them to expect they might achieve.

As will be appreciated by those skilled in the art, for the restoration of the position of the various elements in the opening mechanism shown in FIGS. 8–12 and FIG. 15, an helical spring 208 is provided for connecting the reject door operating bar 120 with the steel case 56 illustrated in detail in FIG. 12. The helical spring 208 serves to urge the reject door operating bar 120 away from the rear section 64 of the cassette 46. As the operating bar 104 is released by releasing engagement with the catch 78 so the helical spring 208 urges closed the secondary door 72 and the reject banknote door 66 while ejecting the secondary door opening projection 134. Those skilled in the art will appreciate that the restoring helical spring 208 may be replaced by spring means operating upon any of the various elements coupled to the secondary door opening bar 100 and the rear door 66 or the primary door guide plate 118.

What I claim is:

1. A system for providing dispensable banknotes from an exchangeable banknote cassette in an autoteller, said system comprising:

a cassette for holding a supply of banknotes, said cassette comprising an opening mechanism for opening a door in said cassette to allow access to the supply of banknotes, a lock mechanism reversably operable in response to the insertion and the turning therein of a predetermined key to pass from a locked state wherein said lock mechanism is operative to prevent operation of said opening mechanism to an open state wherein said lock mechanism is operative to allow operation of said opening mechanism, said lock mechanism being operable to retain said key when in said open state, and a tilt sensor within said cassette operable to prevent operation of said opening mechanism if said cassette is not within a predetermined range of angles to the horizontal; and a banknote dispenser, said dispenser comprising a ramp for holding said cassette at an angle to the horizontal which is within said predetermined range and a key assembly for holding said key as a captive key and for presenting said key to said lock mechanism, said dispenser and said cassette being cooperative to prevent external access to the supply of banknotes when said opening mechanism is operated with said cassette on said ramp and said lock mechanism being presentable to said key when said cassette is not on said ramp only with said cassette at an angle to the horizontal which is outside of said predetermined range.

2. A system according to claim 1 comprising a processor, coupled to monitor transactions carried out by said autoteller and operable to maintain a continuous audit of said autoteller, and a printer operable in response to commands from said processor to print an audit slip, said printer disposed internal to said autoteller and positioned to deny customer access to said printer and said audit slip, said processor being coupled to detect initiation of internal access for service by service personnel and being operable in response thereto to command said printer to provide to said service personnel a first audit slip indicative of the state of said continuous audit immediately prior to said service, said processor being operable thereafter to command said printer to provide to said service personnel a second audit slip indicative of the state of said continuous audit immediately after said service, said first and second audit slips being operative to provide tangible accountability for said service personnel.

3. A system according to claim 2 comprising a keyboard disposed internal to said autoteller and positioned to deny customer access to said keyboard, said processor being operable, in the course of said service, to provide indication to said service personnel that a password entry is required on said keyboard, said processor being coupled to monitor said keyboard and being operable, in response to entry of a first predetermined password, to perform a bank service routine wherein totals in said continuous audit are selectably alterable, said processor being operable in response to entry of a second predetermined password to perform a third party service routine wherein said totals are not selectably alterable, and said processor being operable in response to failure to enter either said first predetermined password or said second predetermined password in less than a predetermined number of tries within a predetermined period to shut down further operation of said autoteller and to provide an external alarm.

4. A system according to claim 3 wherein said opening mechanism comprises an operating bar to be moved when said lock mechanism is in said open state to open said door, said operating bar comprising a notch and said tilt sensor comprising a blocking bar, said blocking bar being freely rotatably mounted on a pivot for said blocking bar to hang under the influence of gravity, said pivot, said blocking bar and said notch being relatively mutually disposed prior to movement of said operating bar for said blocking bar to engage said notch whenever said cassette is at an angle to the horizontal which is outside of said predetermined range for said blocking bar to oppose opening of said door through opposition to movement of said operating bar.

5. A system according to claim 3 wherein said opening mechanism comprises an operating bar to be moved when said lock mechanism is in said open state to open said door, said operating bar comprising first and second notches on opposed sides thereof and said tilt sensor comprising first and second blocking bars each freely rotatably mounted respectively on first and second pivots for each of said first end and second blocking bars to hang under the influence of gravity, said first and second pivots, said first and second notches and said first and second blocking bars being relatively mutually disposed prior to movement of said operating bar for said first blocking bar to engage said first notch whenever said cassette is at an angle to the horizontal lying within a first sub-range which is outside of said predetermined range, and for said second blocking bar to engage said second notch whenever said cassette is at an angle to the horizontal lying within a second subrange which is outside of said predetermined range, said first blocking bar or said second blocking bar being operative to oppose movement of said operating bar and thereby to oppose opening of said door whenever said cassette is at an angle to the horizontal which is outside of said predetermined range.

6. A system according to claim 3 wherein said banknote dispenser is adapted to support on said ramp a plurality of said banknote cassettes, said dispenser comprising a corresponding plurality of individually operable key assemblies each with its corresponding, own unique key for use on a corresponding one of said plurality of cassettes for preventing the insertion and opening of a cassette other than in a predetermined operating position.

7. A system according to claim 3 wherein said cassette comprises a flag for indicating when said door is open, said autoteller comprising a detector for detecting said flag when said cassette is on said ramp and for providing an indication to said processor that said door is open.

8. A system according to claim 2 wherein said opening mechanism comprises an operating bar to be moved when said lock mechanism is in said open state to open said door, said operating bar comprising a notch and said tilt sensor comprising a blocking bar, said blocking bar being freely rotatably mounted on a pivot for said blocking bar to hang under the influence of gravity, said pivot, said blocking bar and said notch being relatively mutually disposed prior to movement of said operating bar for said blocking bar to engage said notch whenever said cassette is at an angle to the horizontal which is outside of said predetermined range for said blocking bar to oppose opening of said door through opposition to movement of said operating bar.

9. A system according to claim 2 wherein said opening mechanism comprises an operating bar to be moved when said lock mechanism is in said open state to open said door, said operating bar comprising first and second notches on opposed sides thereof and said tilt sensor comprising first and second blocking bars each freely rotatably mounted respectively on first and second pivots for each of said first and second blocking bars to hang under the influence of gravity, said first and second pivots, said first and second notches and said first and second blocking bars being relatively mutually disposed prior to movement of said operating bar for said first blocking bar to engage said first notch whenever said cassette is at an angle to the horizontal lying within a first sub-range which is outside of said predetermined range, and for said second blocking bar to engage said second notch whenever said cassette is at an angle to the horizontal lying within a second sub-range which is outside of said predetermined range, said first blocking bar or said second blocking bar being operative to oppose movement of said operating bar and thereby to oppose opening of said door whenever said cassette is at an angle to the horizontal which is outside of said predetermined range.

10. A system according to claim 2 wherein said banknote dispenser is adapted to support on said ramp a plurality of said banknote cassettes, said dispenser comprising a corresponding plurality of individually operable key assemblies each with its corresponding, own unique key for use on a corresponding one of said plurality of cassettes for preventing the insertion and opening of a cassette other than in a predetermined operating position.

11. A system according to claim 2 wherein said cassette comprises a flag for indicating when said door is open, said autoteller comprising a detector for detecting said flag when said cassette is on said ramp and for providing an indication to said processor that said door is open.

12. A system according to claim 1 wherein said opening mechanism comprises an operating bar to be moved when said lock mechanism is in said open state to open said door, said operating bar comprising a notch and said tilt sensor comprising a blocking bar, said blocking bar being freely rotatably mounted on a pivot for said blocking bar to hang under the influence of gravity, said pivot, said blocking bar and said notch being relatively mutually disposed prior to movement of said operating bar for said blocking bar to engage said notch whenever said cassette is at an angle to the horizontal which is outside of said predetermined range for said blocking bar to oppose opening of said door through opposition to movement of said operating bar.

13. A system according to claim 1 wherein said opening mechanism comprises an operating bar to be moved when said lock mechanism is in said open state to open said door, said operating bar comprising first and second notches on opposed sides thereof and said tilt sensor comprising first and second blocking bars each freely rotatably mounted respectively on first and second pivots for each of said first and second blocking bars to hang under the influence of gravity, said first and second pivots, said first and second notches and said first and second blocking bars being relatively mutually disposed prior to movement of said operating bar for said first blocking bar to engage said first notch whenever said cassette is at an angle to the horizontal lying within a first sub-range which is outside of said predetermined range, and for said second blocking bar to engage said second notch whenever said cassette is at an angle to the horizontal lying within a second sub-range which is outside of said predetermined range, said first blocking bar or said second blocking bar being operative to oppose movement of said operating bar and thereby to oppose opening of said door whenever said cassette is at an angle to the horizontal which is outside of said predetermined range.

14. A system according to claim 1 wherein said banknote dispenser is adapted to support on said ramp a plurality of said banknote cassettes, said dispenser comprising a corresponding plurality of individually operable key assemblies each with its corresponding, own unique key for use on a corresponding one of said plurality of cassettes for preventing the insertion and opening of a cassette other than in a predetermined operating position.

15. A system according to claim 1 wherein said cassette comprises a flag for indicating when said door is open, said autoteller comprising a detector for detecting said flag when said cassette is on said ramp and for providing an indication to a processor that said door is open.

16. A system comprising:

an exchangeable cassette for holding a supply of banknotes, said cassette including opening means for opening a door in said cassette to allow access to said supply of banknotes, lock means, operable in response to the insertion and turning therein of a predetermined key, for passing from a locked state wherein said lock means is operative to prevent operation of said opening means to an open state wherein said lock means is operative to allow operation of said opening means, and tilt sensor means, within said cassette, for preventing operation of said opening means when said cassette is not within a predetermined range of angles with respect to a horizontal plane; and banknote dispenser means for holding said cassette and cooperating with said cassette to prevent external access to the supply of banknotes.

17. The system in accordance with claim 16 wherein said lock means includes means to retain said key when in said open state.

18. The system in accordance with claim 16 wherein said banknote dispenser means comprises:

ramp means for holding said cassette at an angle with respect to the horizontal plane which is within said predetermined range;

key assembly means for holding said key as a captive key and for presenting said key to said lock means.

19. The system in accordance with claim 18 wherein:

said opening means comprises an operating bar to be moved when said lock means is in said open state to open said door, said operating bar comprising a notch; and said tilt sensor means comprises a blocking bar, said blocking bar being freely rotatably mounted on a pivot for said blocking bar to hang under the influence of gravity, said pivot, said blocking bar and said notch being relatively mutually disposed prior to movement of said operating bar for said blocking bar to engage said notch whenever said cassette is at an angle to the horizontal which is outside of said predetermined range for said blocking bar to oppose opening of said door through opposition to movement of said operating bar.

20. The system in accordance with claim 18 wherein:

said opening means comprises an operating bar to be moved when said lock mechanism is in said open state to open said door, said operating bar comprising first and second notches on opposed sides thereof; and said tilt sensor means comprises first and second blocking bars each freely rotatably mounted respectively on first and second pivots for each of said first and second blocking bars to hang under the influence of gravity, said first and second pivots, said first and second notches and said first and second blocking bars being relatively mutually disposed prior to movement of said operating bar for said first blocking bar to engage said first notch whenever said cassette is at an angle to the horizontal lying within a first sub-range which is outside of said predetermined range, and for said second blocking bar to engage said second notch whenever said cassette is at an angle to the horizontal lying within a second sub-range which is outside of said predetermined range, said first blocking bar or said second blocking bar being operative to oppose movement of said operating bar and thereby to oppose opening of said door whenever said cassette is at an angle to the horizontal which is outside of said predetermined range.

21. The system in accordance with claim 16 wherein:

said opening means comprises an operating bar to be moved when said lock means is in said open state to open said door, said operating bar comprising a notch; and said tilt sensor means comprises a blocking bar, said blocking bar being freely rotatably mounted on a pivot for said blocking bar to hang under the influence of gravity, said pivot, said blocking bar and said notch being relatively mutually disposed prior to movement of said operating bar for said blocking bar to engage said notch whenever said cassette is at an angle to the horizontal which is outside of said predetermined range for said blocking bar to oppose opening of said door through opposition to movement of said operating bar.

22. The system in accordance with claim 16 wherein:

said opening means comprises an operating bar to be moved when said lock mechanism is in said open state to open said door, said operating bar comprising first and second notches on opposed sides thereof; and said tilt sensor means comprises first and second blocking bars each freely rotatably mounted respectively on first and second pivots for each of said first and second blocking bars to hang under the influence of gravity, said first and second pivots, said first and second notches and said first and second blocking bars being relatively mutually disposed prior to movement of said operating bar for said first blocking bar to engage said first notch whenever said cassette is at an angle to the horizontal lying within a first sub-range which is outside of said predetermined range, and for said second blocking bar to engage said second notch whenever said cassette is at an angle to the horizontal lying within a second sub-range which is outside of said predetermined range, said first blocking bar or said second blocking bar being operative to oppose movement of said operating bar and thereby to oppose opening of said door whenever said cassette is at an angle to the horizontal which is outside of said predetermined range.

* * * * *